US011028841B2

(12) United States Patent
Hoehne

(10) Patent No.: US 11,028,841 B2
(45) Date of Patent: Jun. 8, 2021

(54) COOLING DEVICE EQUIPPED WITH A COMPRESSOR DEVICE

(71) Applicant: Pressure Wave Systems GmbH, Taufkirchen (DE)

(72) Inventor: Jens Hoehne, Munich (DE)

(73) Assignee: Pressure Wave Systems GmbH, Taufkirchen (DE)

( * ) Notice: Subject to any disclaimer, the term of this patent is extended or adjusted under 35 U.S.C. 154(b) by 383 days.

(21) Appl. No.: 15/450,053

(22) Filed: Mar. 6, 2017

(65) Prior Publication Data

US 2017/0175729 A1 Jun. 22, 2017

Related U.S. Application Data

(63) Continuation-in-part of application No. PCT/EP2015/070507, filed on Sep. 8, 2015.

(30) Foreign Application Priority Data

Sep. 8, 2014 (DE) ..... 102014217897.5
Sep. 8, 2015 (WO) ..... PCT/EP2015/070507

(51) Int. Cl.
*F04B 45/02* (2006.01)
*F04B 37/12* (2006.01)
(Continued)

(52) U.S. Cl.
CPC ..... *F04B 45/022* (2013.01); *F04B 37/12* (2013.01); *F04B 37/18* (2013.01); *F04B 45/024* (2013.01); *F04B 45/033* (2013.01); *F25B 9/02* (2013.01)

(58) Field of Classification Search
CPC ..... F04B 37/12; F04B 37/18; F04B 45/02; F04B 45/022; F04B 45/024; F04B 45/033;
(Continued)

(56) References Cited

U.S. PATENT DOCUMENTS 1,580,479 A 4/1926 Frankenfield
2,613,607 A * 10/1952 Sheen ..... F04B 5/00 417/388
(Continued)

FOREIGN PATENT DOCUMENTS

CH 457147 B 1/1967
CN 101233318 A 7/2006
(Continued)

OTHER PUBLICATIONS

Atkins, T., & Escudier, M. (2013). reservoir. In A Dictionary of Mechanical Engineering. : Oxford University Press. Retrieved Apr. 24, 2020, from https://www.oxfordreference.com/view/10.1093/acref/9780199587438.001.0001/acref-9780199587438-e-5178. (Year: 2013).*
(Continued)

*Primary Examiner* — Jianying C Atkisson
*Assistant Examiner* — Miguel A Diaz
(74) *Attorney, Agent, or Firm* — Imperium Patent Works; Darien K. Wallace

(57) ABSTRACT

Pulse tube coolers and Gifford-McMahon coolers are used to cool nuclear spin tomographs and cryopumps. To supply cooled working gas, gas compressors and in particular helium compressors are used with rotational or rotary valves. The rate at which compressed helium is introduced into the cooling device and let out again lies in the range of 1 Hz. A problem of conventional screw or piston processors is that oil from the compressor mixes with the working gas and thus contaminates the cooling device. By providing a second compressor stage, a common pump device can be used to pump in both directions, which results in a two-stage compressor device. The working gas is compressed in each flow direction of the working liquid, in one flow direction in the first compressor stage and in the opposite flow direction
(Continued)

in the second compressor stage. Thus, the efficiency of the compressor device is improved.

15 Claims, 7 Drawing Sheets

(51) Int. Cl.
*F04B 37/18* (2006.01)
*F04B 45/033* (2006.01)
*F25B 9/02* (2006.01)

(58) Field of Classification Search
CPC .. F04B 45/0333; F04B 45/0336; F04B 43/02; F04B 43/06; F04B 43/08; F04B 43/073–43/0736; F04B 43/113–43/1136; F04B 43/0054–0072; F04B 43/10; F04B 43/107; F04B 9/08; F04B 9/10; F04B 9/103; F25B 9/02; F25B 9/145; F25B 2309/02; F25B 2309/1415; F25B 2309/1418; F25B 2309/14181; F25B 2309/1421; F02G 2242/10; F02G 2242/42; F17C 2227/0353
See application file for complete search history.

(56) References Cited

U.S. PATENT DOCUMENTS 2,772,543 A * 12/1956 Berry ..... F04B 39/0011 62/213
3,205,679 A * 9/1965 Geist ..... F25B 9/02 62/474
4,551,979 A * 11/1985 Wilensky ..... F01K 19/08 203/DIG. 20
4,553,397 A * 11/1985 Wilensky ..... F01K 19/08 415/176
4,617,801 A * 10/1986 Clark, Jr. ..... F02G 1/04 60/593
4,673,415 A * 6/1987 Stanford ..... B01D 53/04 95/19
4,854,131 A * 8/1989 Sakitani ..... F25B 9/10 62/51.2
5,375,430 A * 12/1994 Siegel ..... A43B 7/005 417/473
5,381,675 A * 1/1995 Siegel ..... F04B 45/022 417/473
5,383,334 A * 1/1995 Kaminishizono ..... F02G 1/043 417/379
6,192,695 B1 * 2/2001 Hirota ..... F25B 41/04 62/159
6,378,312 B1 * 4/2002 Wang ..... F25B 9/145 60/520
9,234,480 B2 * 1/2016 Gayton ..... F02G 1/055
2001/0051099 A1 * 12/2001 Yatsuzuka ..... F04B 35/045 417/417
2005/0210889 A1 * 9/2005 Arman ..... F25B 9/145 62/6
2008/0008605 A1 * 1/2008 Bauer ..... F02M 59/102 417/375
2008/0011154 A1 1/2008 Kong et al. ..... 91/321
2008/0199327 A1 8/2008 Adler ..... 417/254
2009/0129948 A1 * 5/2009 Hoshino ..... F04B 27/1009 417/269
2009/0322094 A1 * 12/2009 Mahawili ..... F04B 9/10 290/55
2009/0324431 A1 * 12/2009 van Boeyen ..... F04B 19/24 417/379
2010/0263750 A1 10/2010 Becker et al. ..... 137/565.3
2011/0189029 A1 * 8/2011 Van De Velde ..... F04B 43/06 417/53
2013/0312452 A1 * 11/2013 Gerlach ..... F04B 45/02 62/498
2014/0219842 A1 * 8/2014 Casella ..... F04B 45/024 417/472
2015/0013333 A1 * 1/2015 Eggler ..... F01K 23/101 60/615
2015/0108980 A1 * 4/2015 Buehler ..... F25B 9/145 324/318
2015/0128616 A1 * 5/2015 Hoehne ..... F04B 43/073 62/6
2016/0032720 A1 * 2/2016 Schexnaider ..... B01D 19/00 95/258
2016/0069359 A1 * 3/2016 Hummelt ..... F04B 37/18 60/327
2016/0208791 A1 * 7/2016 Reeh ..... F04B 19/24
2017/0167475 A1 * 6/2017 Mori ..... F04B 15/08
2017/0191476 A1 * 7/2017 Matsuda ..... F04B 43/08
2017/0218946 A1 * 8/2017 Yamada ..... F04B 43/08
2017/0248350 A1 * 8/2017 Liu ..... F25B 13/00
2017/0350382 A1 * 12/2017 Nakano ..... F04B 11/0058
2018/0328638 A1 * 11/2018 Mahmoud ..... F25B 13/00
2019/0017731 A1 * 1/2019 Mizuno ..... F25B 9/145

FOREIGN PATENT DOCUMENTS

CN 2856477 Y 1/2007
DE 91837 A 6/1896
DE 1077367 B * 3/1960 ..... F04B 37/18
DE 3801160 A1 1/1988
DE 10344698 A1 9/2003
DE 102004020168 A1 * 11/2005 ..... F25B 9/145
DE 202007018538 U1 12/2007
DE 102008060598 A1 6/2010
JP 2011-106755 A 11/2009
WO WO-2010063817 A2 * 6/2010 ..... F04B 39/0011
WO WO2014/016415 A2 7/2013
WO WO 2014/016415 A2 7/2013

OTHER PUBLICATIONS

Marchese, J. (Dec. 1, 2014). Ice Breaker: The Role of the Liquid Receiver. Retrieved Apr. 24, 2020, from https://www.achrnews.com/articles/128203-the-role-of-the-liquid-receiver (Year: 2014).*
Office action of the German Patent Office in the related German patent application DE102014217897.5 dated May 5, 2015 (4 pages).
English translation of Office action of German Patent Office dated May 5, 2015 (3 pages).
Office action of the ChinesePatent Office in the related Chinese patent application CN201580045402.6 dated Jun. 26, 2018 (9 pages).
English translation of Office action of the Chinese Patent Office dated Jun. 26, 2018 (13 pages).
Office action of the Japanese Patent Office in the related Japanese patent application JP2017-512337 dated Jun. 4, 2019, as well as the English translation of the Japanese Office action (11 pages).
Office action of the ChinesePatent Office in the related Chinese patent application CN201580045402.6 dated Mar. 8, 2019 (10 pages).
English translation of Office action of the Chinese Patent Office dated Mar. 8, 2019 (16 pages).

* cited by examiner

COOLING DEVICE EQUIPPED WITH A COMPRESSOR DEVICE

CROSS REFERENCE TO RELATED APPLICATION

This application is filed under 35 U.S.C. § 111(a) and is based on and hereby claims priority under 35 U.S.C. § 120 and § 365(c) from International Application No. PCT/EP2015/070507, filed on Sep. 8, 2015, and published as WO 2016/038041 A1 on Mar. 17, 2016, which in turn claims priority from German Application No. 102014217897.5, filed in Germany on Sep. 8, 2014. This application is a continuation-in-part of International Application No. PCT/EP2015/070507, which is a continuation of German Application No. 102014217897.5. International Application No. PCT/EP2015/070507 is pending as of the filing date of this application, and the United States is an elected state in International Application No. PCT/EP2015/070507. This application claims the benefit under 35 U.S.C. § 119 from German Application No. 102014217897.5. The disclosure of each of the foregoing documents is incorporated herein by reference.

TECHNICAL FIELD

The invention relates a cooling device equipped with a compressor device and to a method for operating the compressor device.

BACKGROUND

Conventionally, pulse tube refrigerators and Gifford-McMahon coolers are used for cooling magnetic resonance scanners and cryo-pumps. These cooling devices use gas compressors, in particular helium compressors, in combination with rotary or turning valves. The rate at which compressed helium is introduced into and removed from the cooling device is in the range of 1 Hz. A problem of conventional screw or piston compressors is that oil from the compressor may get into the working gas and thus enter the cooling device, thereby contaminating the device.

Moreover, acoustic compressors and high frequency compressors are known in which one or more pistons are put in linear resonance oscillation by a magnetic field. Those resonance frequencies are within a range of a few tens of Hertz and therefore are not suited for being used with pulse tube refrigerators and Gifford-McMahon coolers for generating very low temperatures, such as below ten degrees Kelvin.

The Swiss patent document CH457147B discloses a membrane compressor or membrane pump that has a working chamber sub-divided into a gas volume and a liquid volume by an elastic, airtight and liquid-tight membrane. A liquid pump periodically forces liquid into the liquid volume of the working chamber causing the elastic membrane to expand in the direction of the gas volume and to compress the gas in a compression function or to retract away from the gas volume in a pumping function. The disadvantage is that the airtight, liquid-tight and pressure-resistant seal of the elastic membrane in the working chamber is comparatively expensive. The membrane is heavily loaded, particularly in the area of the seal, so that either very expensive materials must be used or a lower service life must be accepted.

The German patent document DE10344698B4 discloses a heat pump and a refrigerating machine with a compressor device. The compressor device includes a compressor chamber in which a balloon is arranged. The balloon is periodically loaded with liquid so that the gas surrounding the balloon is periodically compressed and relaxed again. This has the disadvantage that the balloon casing can scrape or rub under certain operating states on the hard and possibly edged inner surface of the compressor chamber. As a result, perforations or fissures in the balloon casing can form due to the pressure conditions. Moreover, the permeability of the balloon casing is too high when helium is used as the working gas, causing substantial quantities of helium to be quickly lost. Thus, the service life of such systems that use balloons is unsatisfactory.

The German patent document DE91837 discloses a membrane pump for liquids that may also be used as a "gas compression pump". A liquid is introduced between a membrane and the piston valves such that the liquid is present in the gas chamber. The device thus is a compression device with a liquid seal. There is no physical separation of the gas to be compressed and the hydraulic liquid.

The published international patent application WO2014/016415A2 discloses a compressor device that includes a metal bellows as the compressor element, which is impermeable to all working gases except hydrogen. The metal bellows allows the working gas to be kept oil-free. However, on account of an interaction with the working liquid, the efficiency of the compensation container is unsatisfactory. It is an object of the invention to provide a compressor device that uses a metal bellows as the compressor element, but yet that is more efficient than the compressor device of WO2014/016415A2. Furthermore, it is an object of the invention to provide a cooling device for the compressor device.

SUMMARY

The invention relates to a compressor device, to a cooling device equipped therewith, and to a method for operating the compressor device. Pulse tube coolers and Gifford-McMahon coolers are used to cool nuclear spin tomographs and cryopumps. To supply cooled working gas to the cooling device, gas compressors and in particular helium compressors are used with rotational or rotary valves. The rate at which compressed helium is introduced into the cooling device and let out again lies in the range of 1 Hz. A problem of conventional screw or piston processors is that oil from the compressor can get into the working gas and thus the cooling device and can contaminate the cooling device. By providing a second compressor stage, a common pump device can be used twice, which results in a two-stage compressor device. The working gas is compressed in each flow direction of the working liquid, in one flow direction in the first compressor stage and in the opposite flow direction in the second compressor stage. Thus, the efficiency of the compressor device is improved.

In a first embodiment, a compressor device includes a first compressor chamber, a second compressor chamber, a pump and a rotary valve. The first compressor chamber is divided by a first metal bellows into a first gas volume inside the first metal bellows and a first liquid volume outside the first metal bellows. A working gas is present in the first gas volume, and a working liquid is present in the first liquid volume. A first working liquid connection is connected to the first liquid volume, and a first high-pressure working gas connection is connected to the first gas volume. The second compressor chamber is divided by a second metal bellows into a second gas volume inside the second metal bellows and a second liquid volume outside the second metal bellows. The working gas is present in the second gas volume, and the working liquid is present in the second liquid volume. A second working liquid connection is connected to the second liquid volume, and a second high-pressure working gas connection is connected to the second gas volume.

The pump compresses the working gas in the first gas volume by pumping the working liquid from the second liquid volume through the second working liquid connection, through the first working liquid connection and into the first liquid volume. The working gas in the second gas volume is compressed as the pump pumps the working liquid from the first liquid volume into the second liquid volume. The working gas flows through both the first high-pressure working gas connection and the second high-pressure working gas connection to the rotary valve.

The compressor device also includes a cooling device, first and second heat exchangers, a low-pressure gas storage container and a high-pressure gas storage container. The rotary valve alternately allows working gas to flow from the high-pressure gas storage container into the cooling device and from the cooling device into the low-pressure gas storage container. The cooling device is a Gifford-McMahon cooler or a pulse tube refrigerator. The working gas flows from the first gas volume, through the first high-pressure working gas connection, through the rotary valve and into the cooling device and also flows from the second gas volume, through the second high-pressure working gas connection, through the rotary valve and into the cooling device. The working gas flows from the first gas volume, through the first high-pressure working gas connection, through the first heat exchanger and through the rotary valve. The working gas also flows from the second gas volume, through the second high-pressure working gas connection, through the second heat exchanger and through the rotary valve. The working gas flows from the rotary valve, into the low-pressure gas storage container, through the first low-pressure working gas connection and into the first gas volume. The working gas also flows from the rotary valve, into the low-pressure gas storage container, through the second low-pressure working gas connection and into the second gas volume.

The compressor device also includes a first low-pressure check valve and a first high-pressure check valve. The first low-pressure check valve is connected to the first low-pressure working gas connection and permits working gas to flow only in a direction through the first low-pressure working gas connection and into the first gas volume. The first high-pressure check valve is connected to the first high-pressure working gas connection and permits working gas to flow only in a direction out of the first gas volume and through the first high-pressure working gas connection.

In a second embodiment, the compressor device includes the first compressor chamber, the second compressor chamber, the pump, the rotary valve and a buffer storage container. The first compressor chamber includes the first metal bellows that divides the first compressor chamber into the first gas volume inside the first metal bellows and the first liquid volume outside the first metal bellows. The working gas is present in the first gas volume, and the working liquid is present in the first liquid volume. The high-pressure check valve permits the working gas to flow only in a direction out of the first gas volume. The second compressor chamber includes the second metal bellows that divides the second compressor chamber into the second gas volume inside the second metal bellows and the second liquid volume outside the second metal bellows. The working gas is present in the second gas volume, and the working liquid is present in the second liquid volume. The low-pressure check valve permits the working gas to flow only in a direction into the second gas volume.

The pump pumps the working liquid between the first liquid volume and the second liquid volume. The working gas in the first gas volume is compressed as the pump pumps the working liquid from the second liquid volume into the first liquid volume. The working gas in the second gas volume is also compressed as the pump pumps the working liquid from the first liquid volume into the second liquid volume. The working gas flows from the first gas volume, through the high-pressure check valve, through the buffer storage container, through the low-pressure check valve and into the second gas volume.

The compressor device of the second embodiment also includes a cooling device. The working gas flows from the second gas volume to the cooling device, and the working gas flows from the cooling device to the first gas volume. The cooling device is a Joule-Thomson cooler.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

The compressor device according to the present invention can be designed either as a non-transporting compressor device 10 or as a transporting compressor device 11. In the non-transporting configuration, a predetermined amount of working gas 12 is alternately compressed and relaxed in two transporting stages. No working gas is supplied from the outside or discharged to the outside in the non-transporting compressor device 10.

Figure 1:
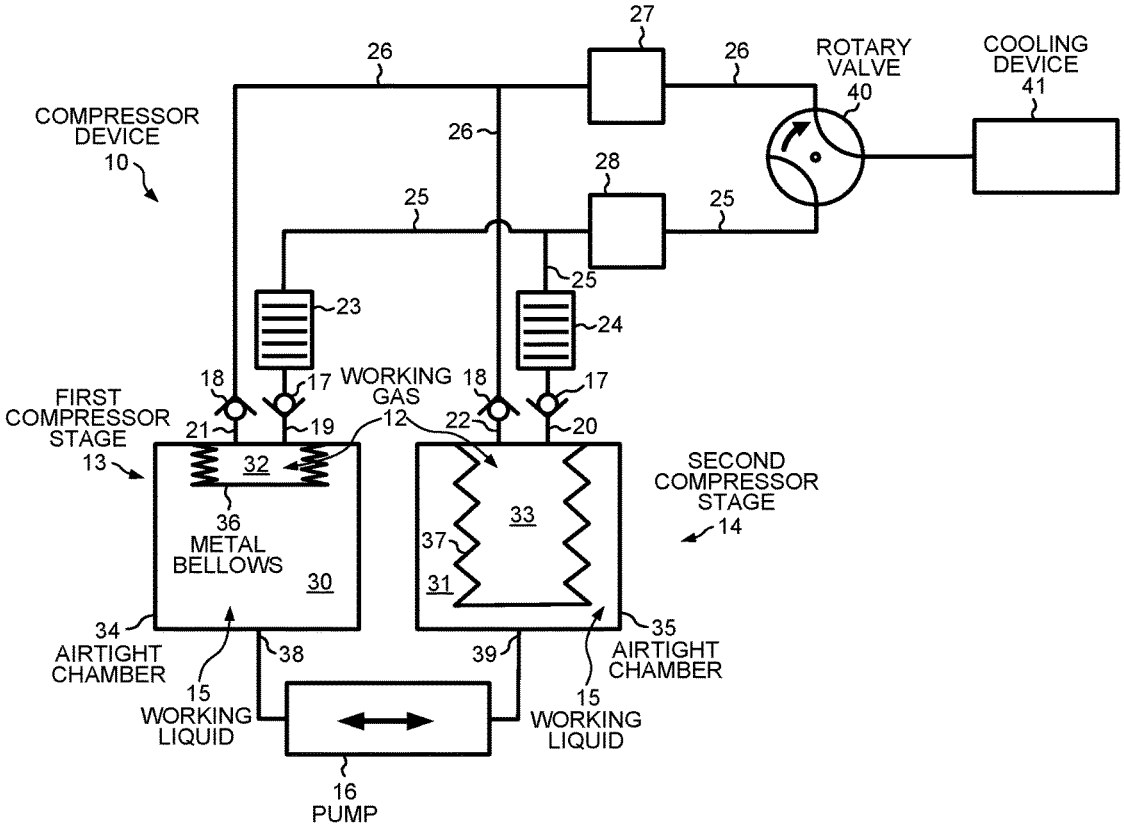
FIG. 1 is a schematic diagram of a first embodiment of the invention as a non-transporting compressor device with two compressor stages.

FIG. 1 shows a first embodiment of compressor device 10 that has a first compressor stage 13 and a second compressor stage 14. Compressor device 10 is non-transporting. By expanding the effective compensation container that holds a working liquid 15 to the second compressor stage 14, a common pump device 16 can be used twice. The working gas 12 is compressed in each direction of flow of the working liquid 15, both in the direction of flow towards the first compressor stage 13 and in the opposite direction of flow towards the second compressor stage 14. Thus, the efficiency of the compressor device 10 is enhanced.

The gas flow is controlled in a simple manner during compression and relaxation of the gas using check valves 17 at high-pressure working gas connections 19-20 and by using check valves 18 at low-pressure working gas connections 21-22. The compressed working gas 12 is cooled after each compression stroke in the two compressor stages 13-14 using heat exchangers 23-24 downstream of the high pressure working gas connections 19-20.

A high-pressure gas line 25 and a low-pressure gas line 26 are configured to store gas on account of their volume. Alternatively, a low-pressure gas storage container 27 and a high-pressure gas storage container 28 are provided in the high-pressure gas line 25 and in the low-pressure gas line 26, respectively.

In the transporting configuration of a second compressor device 11, the working gas 12 is first compressed or pre-compressed in the first compressor stage 13 and stored intermediately in a buffer storage container 29. The second compressor stage 14 operates in an idle mode and serves as a compensation container 31 for the working liquid 15. When an amount of working gas 12 at a middle pressure Pmid is reached in the buffer storage 29, which corresponds to the second gas volume 33 in the second compressor stage 14, during the next compressor stroke the pre-compressed working gas 12 from the buffer storage 29 is compressed in the second compressor stage 14 to an end pressure Pend. The working gas 12 compressed to an end pressure Pend is then released to the outside or stored in the high-pressure gas storage container 28.

In the transporting configuration of the first compressor device 10, the working gas 12 is first compressed or pre-compressed in the first compressor stage 13 and at the same time is transferred into the second gas volume 33 of the second compressor stage 14. In the second compressor stage 14, the working gas 12 which has been pre-compressed to a middle pressure Pmid is then compressed to the end pressure Pend. The working gas 12 which has been compressed to the end pressure Pend is then released to the outside or stored in the high-pressure gas storage container 28.

Hydraulic oil as defined by the German Industry Standard DIN 51524 is preferably used as the working liquid 15, which is additionally water-free or desiccated. In the first and second compressor devices 10 and 11, the hydraulic oil is present in a closed system comprising the pump 16, the working liquid compensation container 31 and a liquid volume 30 in the compressor chamber 13 such that during operation no water from the environment can be absorbed by the hydraulic oil. Alternatively, water can also be used as the working liquid 15. Water is also advantageous as the working liquid because in the case of a defect, water that has penetrated into a downstream cryo-cooler can be removed more easily than can hydraulic oil that has penetrated into a downstream cooler. Water also is more advantageous as a working liquid in explosion-protected applications because water is noncombustible and non-explosive. Moreover, water is non-toxic and therefore environmentally friendly.

For cryo-applications, helium, neon or nitrogen are preferably used as the working gas 12, depending on the temperature range.

FIG. 1 shows the compressor device 10 as the first embodiment, which has a first compressor stage 13 and a second compressor stage 14. Device 10 is a non-transporting compressor device because the working gas is not transported out of the device. Each of the two compressor devices 13-14 has a compressor chamber 34-35 that is closed in an airtight manner. A metal bellows 36-37 is arranged in each of the two compressor chambers 34-35. The metal bellows 36 subdivides the compressor chamber 34 into a first gas volume 32 and a first liquid volume 30. The metal bellows 37 subdivides the compressor chamber 35 into a second gas volume 33 and a second liquid volume 31. The first gas volume 32 and the second gas volume 33 contain the working gas 12. The first liquid volume 30 and the second liquid volume 31 contain the working liquid 15.

The two compressor stages 13-14 are constructed in the same way such that both of the gas volumes 32-33 are equal and both of the liquid volumes 30-31 are equal. The gas volumes 32-33 are inside the metal bellows 36-37, and the liquid volumes are outside the metal bellows 36-37. A connection 38-39 for the working fluid leads out of each of the liquid volumes 30-31. The gas volumes 32-33 are each connected both to a high-pressure working gas connection 19-20 and to a low-pressure working gas connection 21-22. The low-pressure working gas connections 21-22 are provided with check valves 18 that are permeable in the direction of compressor stages 13-14. The high-pressure working gas connections 19-20 are provided with check valves 17 that, in contrast to check valves 18 at the low-pressure working gas connections 21-22, have opposite forward directions. Thus, the check valves 17 permit working gas to flow only in the direction out of the gas volumes 32-33, and the check valves 18 permit working gas to flow only in the direction into the gas volume 32-33. The high-pressure working gas connections 19-20 are connected to the common high-pressure gas line 25 via the check valves 17. The low-pressure working gas connections 21-22 are connected to the low-pressure gas line 26 via the check valves 18.

The check valves 17 in the high-pressure working gas connections 19-20 are permeable in the direction of the common high-pressure gas line 25, and the check valves 18 in the low-pressure working gas connections 21-22 are permeable in the direction of the compressor stages 13-14. The common high-pressure gas line 25 and the common low-pressure gas line 26 end in a motor rotary valve 40 and alternately connect the high-pressure gas line 25 and the low-pressure gas line 26 to a cooling device 41. The cooling device 41 may be a Giffon-McMahon cooler or a pulse tube refrigerator. In some aspects, the cooling device is considered part of the compressor device. In other aspects, the compressor device and the cooling device are separate components. Due to their volume, the high-pressure gas line 25 and the low pressure gas line 26 act as gas storage. In addition, the low-pressure gas storage container 27 and the high-pressure gas storage container 28 are provided in the high-pressure and low-pressure gas lines 25-26. The heat exchangers 23-24 for cooling the compressed working gas are connected downstream of check valves 17 on the two high-pressure working gas connections 19-20. The two working liquid connections 38-39 are connected to a common electromotive pump device 16 that alternatingly pumps working liquid 15 into the first and second liquid volumes 30-31 of the first and second compressor stages 13-14. Either the working liquid 15 is pumped from the second liquid volume 31 into the first liquid volume 30 or vice versa.

FIGS. 2A-2E illustrate the different operating phases of the compressor device 10 of FIG. 1. In a first phase shown in FIG. 2A, working liquid 15 is pumped by the common pump device 16 from the second liquid volume 31 of the second compressor stage 14 into the first liquid volume 30 of the first compressor stage 13. The first metal bellows 36 is compressed, and the working gas 12 therein is forced into the high-pressure storage 28 via the first high-pressure working gas connection 19, the first heat exchanger 23 and the common high-pressure gas line 25. The second metal bellows 37 expands through working gas 12 that flows back from the low-pressure working gas storage 27 via the low-pressure gas line 26 and the second low-pressure working gas connection 22. The rotary valve 40 connects the cooling device 41 via low-pressure gas line 26 to low-pressure gas storage 27.

Figure 2A:
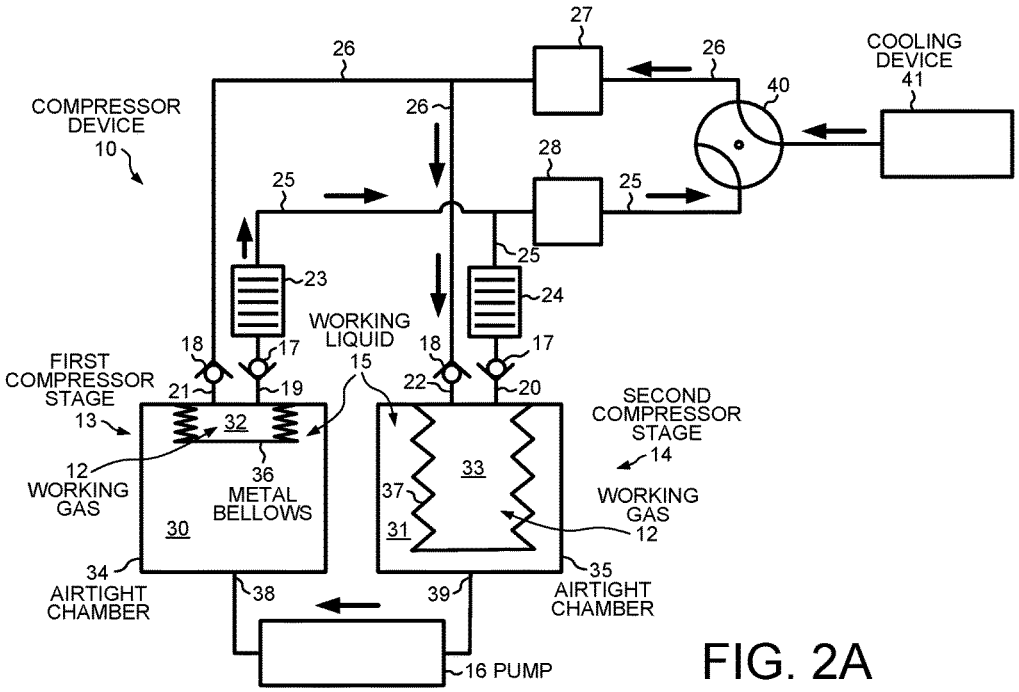
FIG. 2A illustrates a first operating phase of the compressor device of FIG. 1.
Figure 2B:
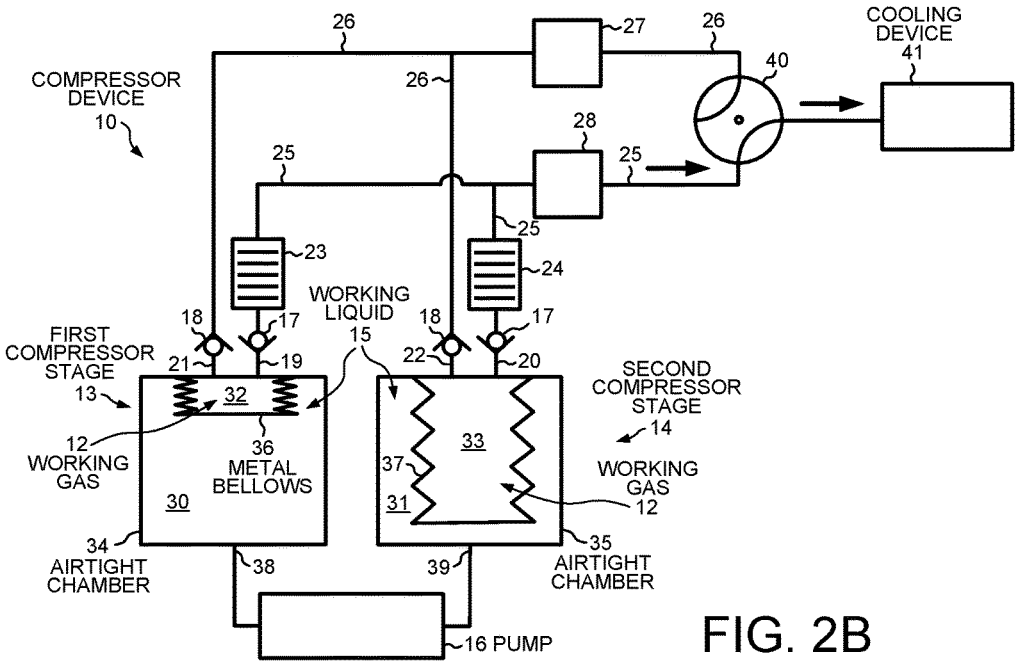
FIG. 2B illustrates a second operating phase of the compressor device of FIG. 1.

In the second operating phase shown in FIG. 2B, compression in the first compressor stage 13 is completed, and the rotary valve 40 connects the high-pressure gas storage 28 to the cooling device 41 so that compressed working gas 12 cooled in the first heat exchanger 23 enters the cooling device 41.

Figure 2C:
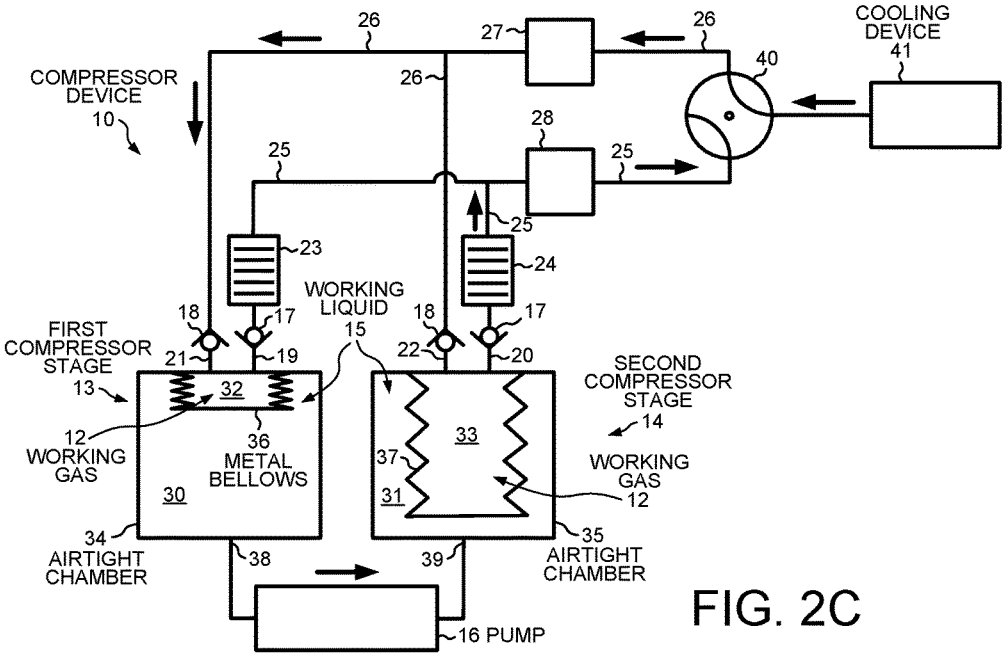
FIG. 2C illustrates a third operating phase of the compressor device of FIG. 1.

In the third phase shown in FIG. 2C, the flow of working liquid is reversed, and the pumping device 16 now pumps working liquid 15 from the first liquid volume 30 of the first compressor stage 13 into the second liquid volume 31 in the second compressor stage 14. In so doing, the second metal bellows 37 is compressed, and the working gas 12 therein is compressed and forced into the high-pressure gas storage 28 via the second high-pressure working gas connection 20, the second heat exchanger 24 and the common high-pressure gas line 25. The first metal bellows 36 expands through working gas 12 flowing back from the low-pressure gas storage 27 via the low-pressure gas line 26 and the first low-pressure working gas connection 21.

Figure 2D:
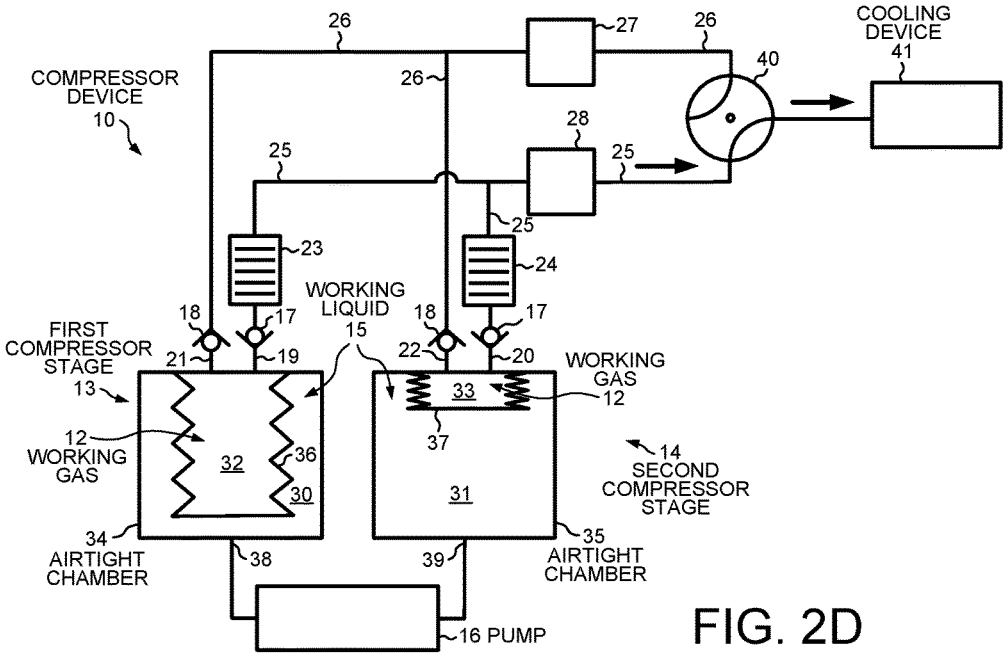
FIG. 2D illustrates a fourth operating phase of the compressor device of FIG. 1.

In the fourth phase shown in FIG. 2D, compression in the second compressor stage 14 is completed, and the rotary valve 40 again connects the high-pressure gas storage 28 to the cooling device 41 via the common high-pressure gas line 25 so that compressed working gas 12 cooled in the second heat exchanger 24 enters the cooling device 41.

Figure 2E:
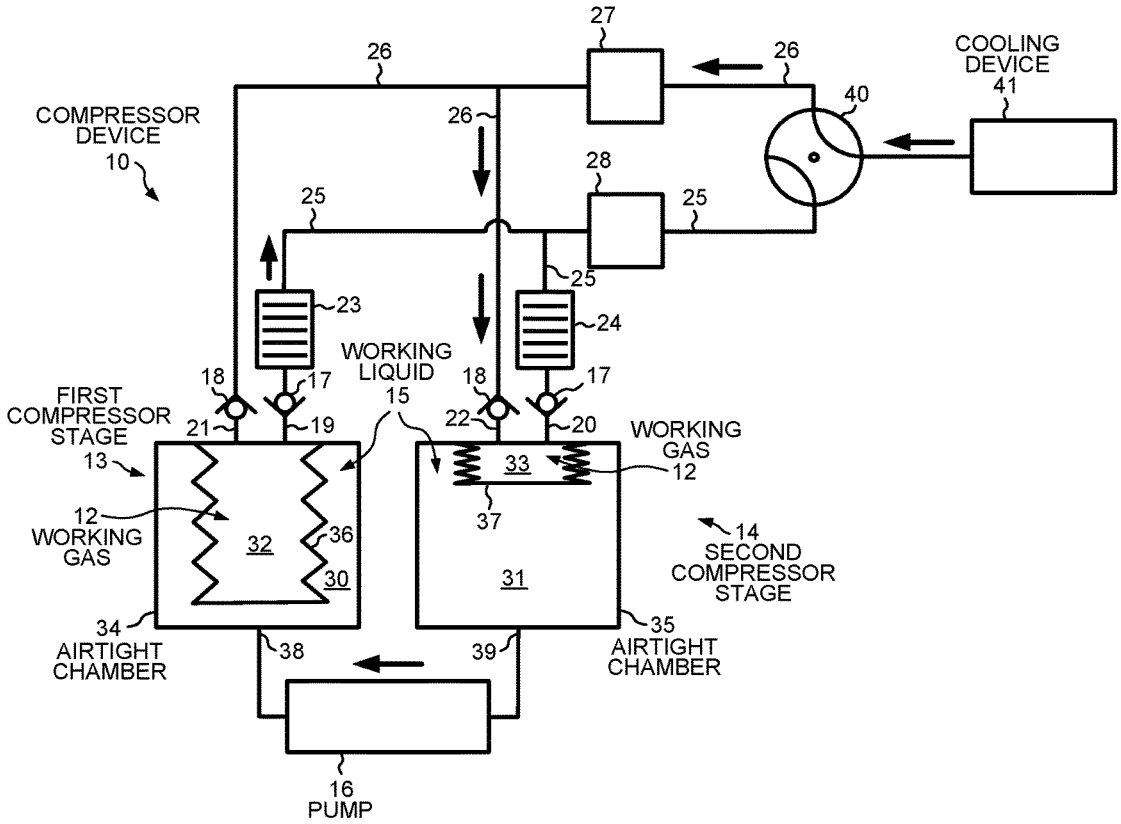
FIG. 2E shows a repeat of the first operating phase in which compression takes place in the first compressor stage.

The operating phase illustrated in FIG. 2E is again the first phase in which compression takes place in the first compressor stage 13. FIG. 2A is distinguishable from FIG. 2E only in that the first metal bellows 36 in FIG. 2E is still relaxed and the second metal bellows 37 is still compressed. In FIG. 2A, compression in the first compressor stage 13 is completed and the first metal bellows 36 is compressed while the second metal bellows 37 is relaxed.

By providing a high-pressure storage 28 and a low-pressure storage 27, the rotational frequency of rotary valve 40 is decoupled from the frequency of compression in the two compressor stages. Alternatively, the rotational frequency of rotary valve 40 is synchronized with the frequency of the compressor strokes. In that case, the high-pressure and low-pressure storage volumes 28, 27 may be dispensed with.

Figure 3:
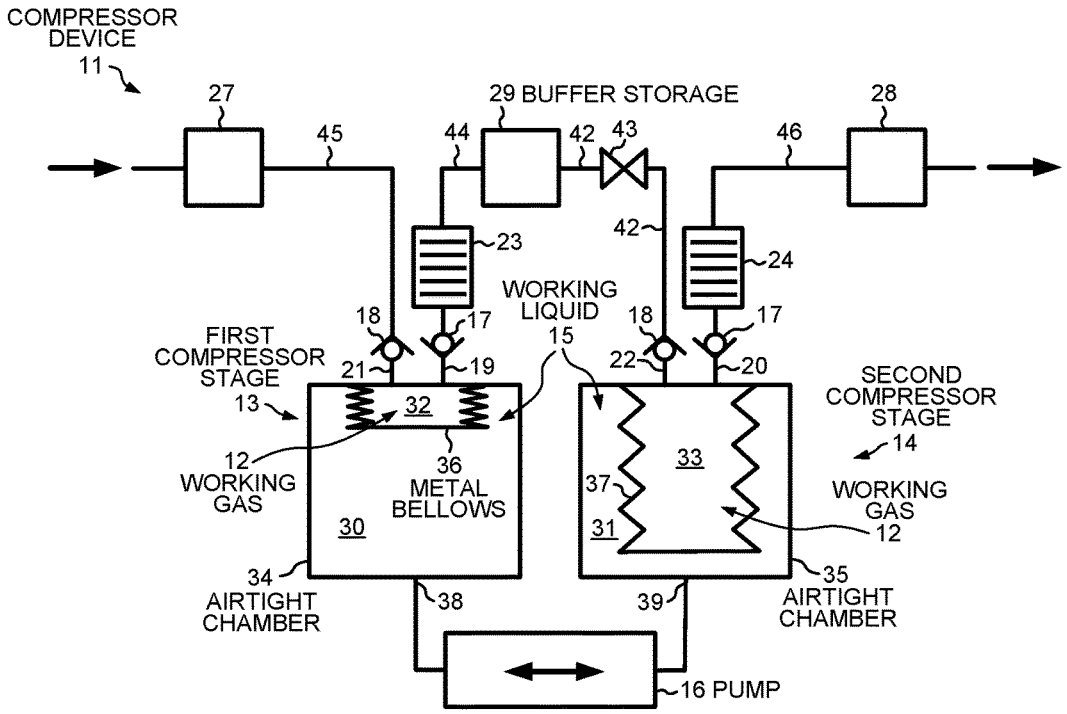
FIG. 3 is a schematic diagram of a second embodiment of the invention as a transporting compressor device with two compressor stages.

FIG. 3 shows the compressor device 11 as the second embodiment that transports working gas 12 and includes the two compressor stages 13-14. Device 11 is a transporting compressor device because the working gas 12 is transported out of the device. Similar components in both devices 10 and 11 are labeled with the same reference numeral. The structure of the two compressor stages 13-14 and the connection of the two compressor stages 13-14 with the common pump device 16 corresponds to the structure shown in FIGS. 1 and 2. Likewise, the structure of the two heat exchangers 23-24 corresponds to the configuration of the first embodiment. In the embodiment of FIG. 3, the working gas 12 is first compressed in the first compressor stage 13 from an outlet pressure P0 to a first middle pressure Pmid1 and subsequently in the second compressor stage 14 from a second middle pressure Pmid2 to an end pressure Pend. Throughout the operation, the first middle pressure Pmid1 is greater than the second middle pressure Pmid2.

Compressor device 11 includes the buffer storage container 29 that is connected via a first gas line 42 and a first lock valve 43 to the second low-pressure working gas connection 22 of the second compressor stage 14. The first high-pressure working gas connection 19 is connected to the buffer storage 29 via the first heat exchanger 23 and a second gas line 44. The low-pressure gas storage 27 is connected via a third gas line 45 and check valve 18 to the first low-pressure working gas connection 21 of the first compressor stage 13. Working gas 12 from the low-pressure gas storage 27 that is to be compressed is supplied to the first compressor stage 13 via the first low-pressure working gas connection 21. The second high-pressure working gas connection 20 of the second compressor stage 14 is connected to the high-pressure gas storage 28 via check valve 17, the second heat exchanger 24 and a fourth gas line 46.

Figure 4A:
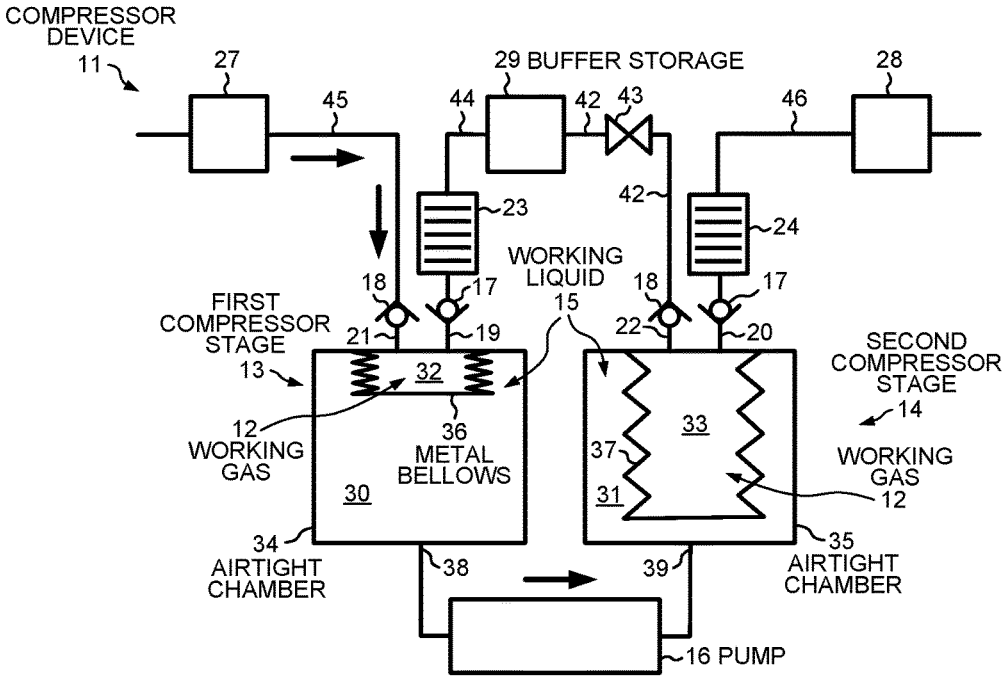
FIG. 4A illustrates a first operating phase of the compressor device of FIG. 3.

FIGS. 4A-4D illustrate the operation of compressor device 11 of FIG. 3. FIG. 4A shows a first operating phase in which working liquid 15 is pumped through the common pump device 16 from the first liquid volume 30 of the first compressor stage 13 into the second liquid volume 31 of the second compressor stage 13. As the first metal bellows 36 expands, uncompressed working gas 12 flows via the third gas line 45, the check valve 18 and the first low-pressure working gas connection 21 into the first gas volume 32. The first lock valve 43 in the first gas line 42 is closed. The second compressor stage 14 merely serves as a compensation container for working liquid 15. In the relaxed state, the pressure in the second gas volume 33 is at the second middle pressure Pmid2. In the compressed state, the pressure in the second gas volume 33 is approximately at the end pressure Pend.

Figure 4B:
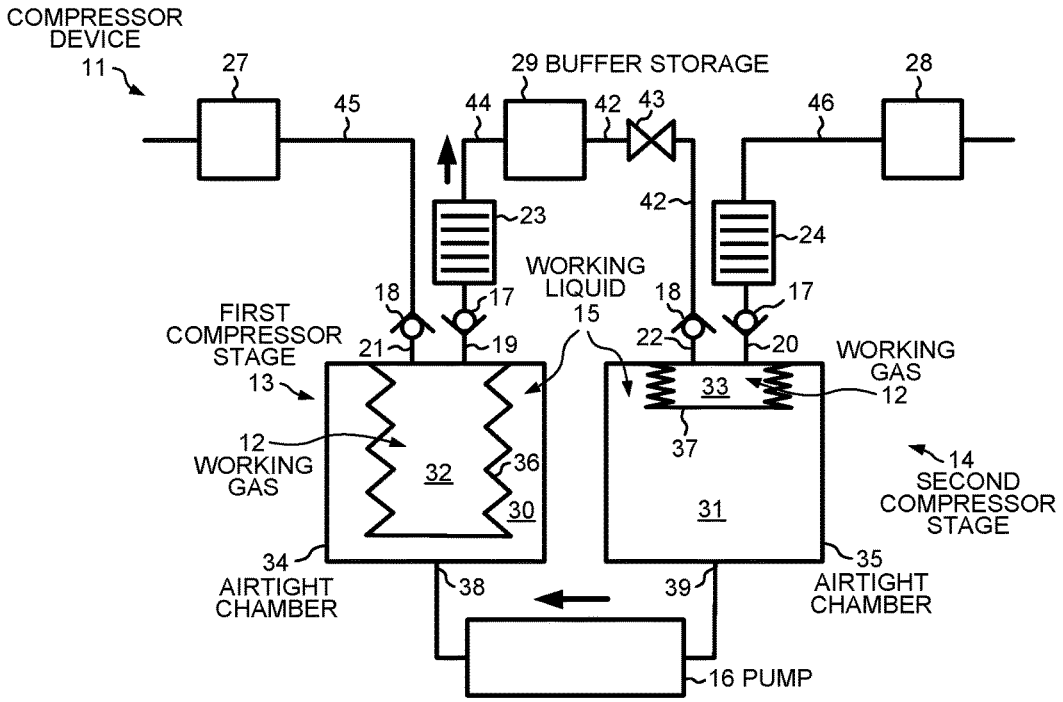
FIG. 4B illustrates a second operating phase of the compressor device of FIG. 3.

FIG. 4B illustrates the second operating phase in which the flow direction of the working liquid 15 reverses. The working gas 12 in the first compressor stage 13 is compressed and forced into buffer storage 29 through the first high-pressure working gas connection 19, the check valve 17, the first heat exchanger 23 and the second gas line 44. The check valve 17 on the first high-pressure working gas connection 19 prevents working gas 12 that has been compressed to the middle pressure Pmid from flowing back into the first gas volume 32. The first lock valve 43 continues to be closed, and the second compressor stage 14 acts only as a compensation container 31 for working liquid 15.

The operating phases illustrated in FIGS. 4A and 4B are performed repeatedly and for so long as the amount of working gas 12 in the buffer storage 29 that was compressed to the first middle pressure Pmid1 is sufficient to generate the middle pressure Pmid2 in the second gas volume 33 after the buffer storage 29 is connected to the second gas volume 33 through the first gas line 42 and the opened lock valve 43.

Figure 4C:
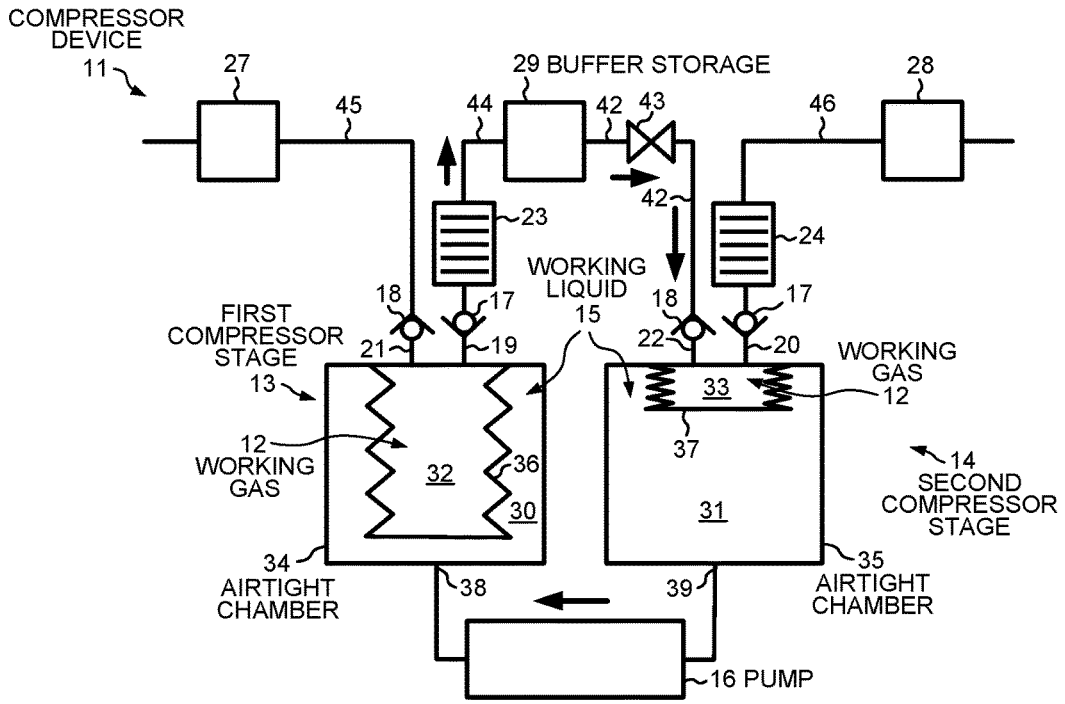
FIG. 4C illustrates a third operating phase of the compressor device of FIG. 3.

FIG. 4C illustrates the flow of working gas 29 and the first middle pressure Pmid1 has been reached in the buffer storage 29. When the sufficient amount of gas is reached to achieve the first middle pressure Pmid1 in the buffer storage 29, the first lock valve 43 is opened during the next compression stroke in the first compressor stage 13 so that the working gas 12 that was pre-compressed to the first middle pressure Pmid1 may flow from buffer storage 29 via the open first lock valve 43 and the first gas line 42 into the second gas volume 33 of the second compressor stage 14, resulting in the second middle pressure Pmid2 in the storage 29 and volume 33.

Figure 4D:
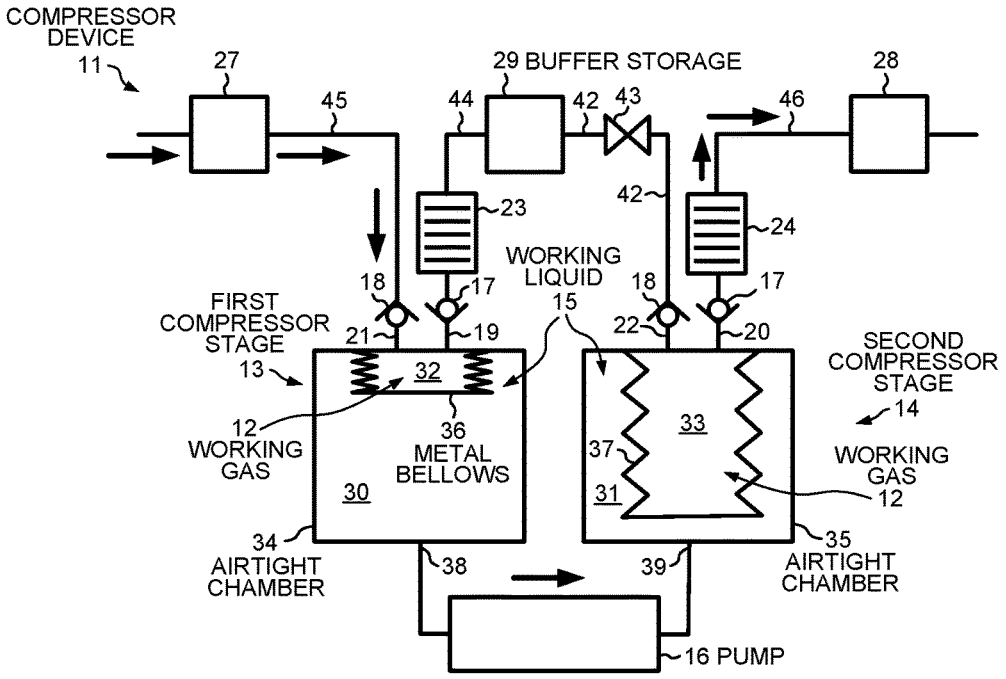
FIG. 4D illustrates a fourth operating phase of the compressor device of FIG. 3.

FIG. 4D illustrates the next operating phase in which the working liquid 15 is pumped through the common pump device 16 into the second compressor stage 14. The working gas 12 present in the second gas volume 33 and pre-compressed to a second middle pressure Pmid2 is continued to be compressed to an end pressure Pend and is forced into the high-pressure storage 28 via the second heat exchanger 24 and the fourth gas line 46. Thus, a compression cycle from an outlet pressure P0 to an end pressure Pend is terminated and the cycle starts again.

In an alternative embodiment to that of FIG. 3, the first high-pressure working gas connection 19 is connected to the low-pressure working gas connection 22 of the second compressor stage 14 through the gas lines 42 and 44. The buffer storage 29 and the first lock valve 43 are not used. In that case, the working gas 12 in the first compressor stage 13 is pre-compressed to a single middle pressure Pmid. In the countermovement of the common electromotive pump device 16, the working gas 12 is then compressed to the end pressure Pend in the second compressor stage 14. The working gas 12 compressed to the end pressure Pend is then released to the outside or stored in a high-pressure storage 28.

Figure 5:
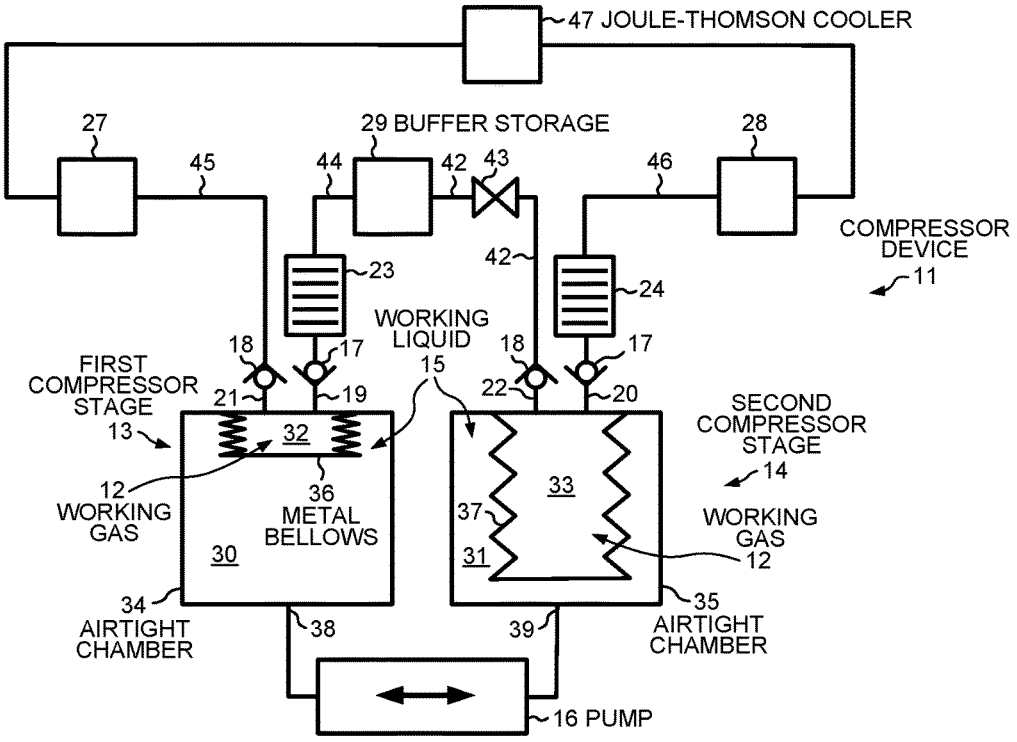
FIG. 5 shows an application of the compressor device of FIG. 3 as a drive for a Joule-Thomson cooler.

FIG. 5 shows an application of the second embodiment 11 as a drive of a Joule-Thomson cooler 47 with a closed working gas loop.

Hydraulic oils as defined by German Industry Standard DIN 51524 are suited as the working liquid 15. The H, HL, HLP and HVLP oils are oils that are readily compatible with customary sealing plastics, such as NBR (acrylonitrile butadiene rubber). However, NBR is not sufficiently helium-impermeable. HF oils are frequently incompatible with customary sealing materials, as described at http://de.wikipedia.org/wiki/Liste_der_Kunststoffe.

Alternatively, water can also be used as the working liquid 15. Water as the working liquid is also advantageous because in the case of defects in a downstream cryo-cooler, penetrated water can more easily be removed than can hydraulic oil that has penetrated into a cooler connected downstream. In addition, water is appropriate as the working liquid in applications protected against explosions because water is non-combustible and non-explosive. Moreover, water is non-toxic and therefore environmentally friendly.

REFERENCE NUMERALS

P0 outlet pressure
Pmid1 middle pressure 1
Pmid2 middle pressure 2
Pend end pressure
10 transporting compressor device
11 non-transporting compressor device
12 working gas
13 first compressor stage
14 second compressor stage
15 working liquid
16 common electromotive pump device
17 check valves
18 check valves
19 first high-pressure working gas connection
20 second high-pressure working gas connection
21 first low-pressure working gas connection
22 second low-pressure working gas connection
23 first heat exchanger
24 second heat exchanger
25 high-pressure gas line
26 low-pressure gas line
27 low pressure gas storage
28 high-pressure gas storage
29 buffer storage
30 first liquid volume
31 second liquid volume
32 first gas volume
33 second gas volume
34 first compressor chamber
35 second compressor chamber
36 first metal bellows
37 second metal bellows
38 first working liquid connection
39 second working liquid connection
40 electromotive rotary valve
41 cooling device
42 first gas line
43 first lock valve
44 second gas line
45 third gas line
46 fourth gas line
47 Joule-Thomson cooler Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. A compressor device, comprising:

a first compressor chamber that is divided by a first metal bellows into a first gas volume inside the first metal bellows and a first liquid volume outside the first metal bellows, wherein a working gas is present in the first gas volume, and wherein a working liquid is present in the first liquid volume;

a first working liquid connection connected to the first liquid volume;

a first high-pressure working gas connection connected to the first gas volume;

a first low-pressure working gas connection connected to the first gas volume;

a first high-pressure check valve connected to the first high-pressure working gas connection, wherein the first high-pressure check valve is adapted to permit working gas to flow only in a direction out of the first gas volume and through the first high-pressure working gas connection;

a first low-pressure check valve connected to the first low-pressure working gas connection, wherein the first low-pressure check valve is adapted to permit working gas to flow only in a direction through the first low-pressure working gas connection and into the first gas volume;

a second compressor chamber that is divided by a second metal bellows into a second gas volume inside the second metal bellows and a second liquid volume outside the second metal bellows, wherein the working gas is present in the second gas volume, and wherein the working liquid is present in the second liquid volume;

a second working liquid connection connected to the second liquid volume;

a second high-pressure working gas connection connected to the second gas volume;

a second low-pressure working gas connection connected to the second gas volume;

a second high-pressure check valve connected to the second high-pressure working gas connection, wherein the second high-pressure check-valve is adapted to permit the working gas to flow only in a direction out of the second gas volume;

a second low-pressure check valve connected to the second low-pressure working gas connection, wherein the second low-pressure check valve is adapted to permit the working gas to flow only in a direction into the second gas volume;

a pump that compresses the working gas in the first gas volume by pumping the working liquid from the second liquid volume through the second working liquid connection, through the first working liquid connection and into the first liquid volume, and wherein the working gas in the second gas volume is compressed as the pump pumps the working liquid from the first liquid volume into the second liquid volume;

a common high-pressure output connection connected to the first and second high-pressure check valves;

a common low-pressure input connection connected to the first and second low-pressure check valves;

a rotary valve;

a first heat exchanger, wherein the working gas flows from the first gas volume, through the first high-pressure working gas connection, through the first heat exchanger and through the rotary valve; and a second heat exchanger, wherein the working gas flows from the second gas volume, through the second high-pressure working gas connection, through the second heat exchanger and through the rotary valve.

2. A compressor device, comprising:

a first compressor chamber that is divided by a first metal bellows into a first gas volume inside the first metal bellows and a first liquid volume outside the first metal bellows, wherein a working gas is present in the first gas volume, and wherein a working liquid is present in the first liquid volume;

a first working liquid connection connected to the first liquid volume;

a first high-pressure working gas connection connected to the first gas volume;

a first low-pressure working gas connection connected to the first gas volume;

a first high-pressure check valve connected to the first high-pressure working gas connection, wherein the first high-pressure check valve is adapted to permit working gas to flow only in a direction out of the first gas volume and through the first high-pressure working gas connection;

a first low-pressure check valve connected to the first low-pressure working gas connection, wherein the first low-pressure check valve is adapted to permit working gas to flow only in a direction through the first low-pressure working gas connection and into the first gas volume;

a second compressor chamber that is divided by a second metal bellows into a second gas volume inside the second metal bellows and a second liquid volume outside the second metal bellows, wherein the working gas is present in the second gas volume, and wherein the working liquid is present in the second liquid volume;

a second working liquid connection connected to the second liquid volume;

a second high-pressure working gas connection connected to the second gas volume;

a second low-pressure working gas connection connected to the second gas volume;

a second high-pressure check valve connected to the second high-pressure working gas connection, wherein the second high-pressure check-valve is adapted to permit the working gas to flow only in a direction out of the second gas volume;

a second low-pressure check valve connected to the second low-pressure working gas connection, wherein the second low-pressure check valve is adapted to permit the working gas to flow only in a direction into the second gas volume;

a pump that compresses the working gas in the first gas volume by pumping the working liquid from the second liquid volume through the second working liquid connection, through the first working liquid connection and into the first liquid volume, and wherein the working gas in the second gas volume is compressed as the pump pumps the working liquid from the first liquid volume into the second liquid volume;

a common high-pressure output connection connected to the first and second high-pressure check valves;

a common low-pressure input connection connected to the first and second low-pressure check valves;

a rotary valve; and a cryo-cooler, wherein the working gas flows through the first high-pressure working gas connection, through the rotary valve and to the cryo-cooler, and wherein the working gas flows through the second high-pressure working gas connection, through the rotary valve and to the cryo-cooler.

3. A compressor device, comprising:

a first compressor chamber that is divided by a first metal bellows into a first gas volume inside the first metal bellows and a first liquid volume outside the first metal bellows, wherein a working gas is present in the first gas volume, and wherein a working liquid is present in the first liquid volume;

a first working liquid connection connected to the first liquid volume;

a first high-pressure working gas connection connected to the first gas volume;

a first low-pressure working gas connection connected to the first gas volume;

a first high-pressure check valve connected to the first high-pressure working gas connection, wherein the first high-pressure check valve permits working gas to flow only in a direction out of the first gas volume and through the first high-pressure working gas connection;

a first low-pressure check valve connected to the first low-pressure working gas connection, wherein the first low-pressure check valve permits working gas to flow only in a direction through the first low-pressure working gas connection and into the first gas volume;

a second compressor chamber that is divided by a second metal bellows into a second gas volume inside the second metal bellows and a second liquid volume outside the second metal bellows, wherein the working gas is present in the second gas volume, and wherein the working liquid is present in the second liquid volume;

a second working liquid connection connected to the second liquid volume;

a second high-pressure working gas connection connected to the second gas volume;

a second low-pressure working gas connection connected to the second gas volume;

a second high-pressure check valve connected to the second high-pressure working gas connection, wherein the second high-pressure check-valve permits the working gas to flow only in a direction out of the second gas volume;

a second low-pressure check valve connected to the second low-pressure working gas connection, wherein the second low-pressure check valve permits the working gas to flow only in a direction into the second gas volume;

a pump that compresses the working gas in the first gas volume by pumping the working liquid from the second liquid volume through the second working liquid connection, through the first working liquid connection and into the first liquid volume, and wherein the working gas in the second gas volume is compressed as the pump pumps the working liquid from the first liquid volume into the second liquid volume;

a common high-pressure output connection connected to the first and second high-pressure check valves;

a common low-pressure input connection connected to the first and second low-pressure check valves;

a high-pressure gas storage container having a high-pressure input and a high-pressure output, wherein the high-pressure input is connected to the common high-pressure output connection;

a low-pressure gas storage container having a low-pressure input and a low-pressure output, wherein the low-pressure output is connected the common low-pressure input connection; and a rotary valve connected to the high-pressure output of the high-pressure gas storage container and connected to the low-pressure input of the low-pressure gas storage container.

4. A compressor device, comprising:

a first compressor chamber that is divided by a first metal bellows into a first gas volume inside the first metal bellows and a first liquid volume outside the first metal bellows, wherein a working gas is present in the first gas volume, and wherein a working liquid is present in the first liquid volume;

a first working liquid connection connected to the first liquid volume;

a first high-pressure working gas connection connected to the first gas volume;

a first low-pressure working gas connection connected to the first gas volume;

a first high-pressure check valve connected to the first high-pressure working gas connection, wherein the first high-pressure check valve permits working gas to flow only in a direction out of the first gas volume and through the first high-pressure working gas connection;

a first low-pressure check valve connected to the first low-pressure working gas connection, wherein the first low-pressure check valve permits working gas to flow only in a direction through the first low-pressure working gas connection and into the first gas volume;

a second compressor chamber that is divided by a second metal bellows into a second gas volume inside the second metal bellows and a second liquid volume outside the second metal bellows, wherein the working gas is present in the second gas volume, and wherein the working liquid is present in the second liquid volume;

a second working liquid connection connected to the second liquid volume;

a second high-pressure working gas connection connected to the second gas volume;

a second low-pressure working gas connection connected to the second gas volume;

a second high-pressure check valve connected to the second high-pressure working gas connection, wherein the second high-pressure check-valve permits the working gas to flow only in a direction out of the second gas volume;

a second low-pressure check valve connected to the second low-pressure working gas connection, wherein the second low-pressure check valve permits the working gas to flow only in a direction into the second gas volume;

a pump that compresses the working gas in the first gas volume by pumping the working liquid from the second liquid volume through the second working liquid connection, through the first working liquid connection and into the first liquid volume, and wherein the working gas in the second gas volume is compressed as the pump pumps the working liquid from the first liquid volume into the second liquid volume;

a common high-pressure output connection connected to the first and second high-pressure check valves;

a common low-pressure input connection connected to the first and second low-pressure check valves;

a high-pressure gas storage container having a high-pressure input and a high-pressure output, wherein the high-pressure input is connected to the common high-pressure output connection;

a low-pressure gas storage container having a low-pressure input and a low-pressure output, wherein the low-pressure output is connected the common low-pressure input connection;

a first heat exchanger, wherein the working gas flows from the first gas volume, through the first high-pressure working gas connection, through the first heat exchanger to the common high-pressure output connection; and a second heat exchanger, wherein the working gas flows from the second gas volume, through the second high-pressure working gas connection, through the second heat exchanger to the common high-pressure output connection.

5. A compressor device, comprising:

a first compressor chamber that is divided by a first metal bellows into a first gas volume inside the first metal bellows and a first liquid volume outside the first metal bellows, wherein a working gas is present in the first gas volume, and wherein a working liquid is present in the first liquid volume;

a first working liquid connection connected to the first liquid volume;

a first high-pressure working gas connection connected to the first gas volume;

a second compressor chamber that is divided by a second metal bellows into a second gas volume inside the second metal bellows and a second liquid volume outside the second metal bellows, wherein the working gas is present in the second gas volume, and wherein the working liquid is present in the second liquid volume;

a second working liquid connection connected to the second liquid volume;

a second high-pressure working gas connection connected to the second gas volume;

a pump that compresses the working gas in the first gas volume by pumping the working liquid from the second liquid volume through the second working liquid connection, through the first working liquid connection and into the first liquid volume, and wherein the working gas in the second gas volume is compressed as the pump pumps the working liquid from the first liquid volume into the second liquid volume;

a rotary valve, wherein the working gas flows through the first high-pressure working gas connection to the rotary valve, and wherein the working gas flows through the second high-pressure working gas connection to the rotary valve;

a cryo-cooler;

a low-pressure gas storage container; and a high-pressure gas storage container, wherein the rotary valve alternately allows working gas to flow from the high-pressure gas storage container into the cryo-cooler and from the cryo-cooler into the low-pressure gas storage container.

6. The compressor device of claim 5, wherein the cryo-cooler is taken from the group consisting of: a Gifford-McMahon cooler and a pulse tube refrigerator.

7. A compressor device, comprising:

a first compressor chamber that is divided by a first metal bellows into a first gas volume inside the first metal bellows and a first liquid volume outside the first metal bellows, wherein a working gas is present in the first gas volume, and wherein a working liquid is present in the first liquid volume;

a first working liquid connection connected to the first liquid volume;

a first high-pressure working gas connection connected to the first gas volume;

a first low-pressure working gas connection connected to the first gas volume;

a first high-pressure check valve connected to the first high-pressure working gas connection, wherein the first high-pressure check valve is adapted to permit working gas to flow only in a direction out of the first gas volume and through the first high-pressure working gas connection;

a first low-pressure check valve connected to the first low-pressure working gas connection, wherein the first low-pressure check valve is adapted to permit working gas to flow only in a direction through the first low-pressure working gas connection and into the first gas volume;

a second compressor chamber that is divided by a second metal bellows into a second gas volume inside the second metal bellows and a second liquid volume outside the second metal bellows, wherein the working gas is present in the second gas volume, and wherein the working liquid is present in the second liquid volume;

a second working liquid connection connected to the second liquid volume;

a second high-pressure working gas connection connected to the second gas volume;

a second low-pressure working gas connection connected to the second gas volume;

a second high-pressure check valve connected to the second high-pressure working gas connection, wherein the second high-pressure check-valve is adapted to permit the working gas to flow only in a direction out of the second gas volume;

a second low-pressure check valve connected to the second low-pressure working gas connection, wherein the second low-pressure check valve is adapted to permit the working gas to flow only in a direction into the second gas volume;

a pump that compresses the working gas in the first gas volume by pumping the working liquid from the second liquid volume through the second working liquid connection, through the first working liquid connection and into the first liquid volume, and wherein the working gas in the second gas volume is compressed as the pump pumps the working liquid from the first liquid volume into the second liquid volume;

a common high-pressure output connection connected to the first and second high-pressure check valves;

a common low-pressure input connection connected to the first and second low-pressure check valves;

a high-pressure gas storage container having a high-pressure input and a high-pressure output, wherein the high-pressure input is connected to the common high-pressure output connection;

a low-pressure gas storage container having a low-pressure input and a low-pressure output, wherein the low-pressure output is connected the common low-pressure input connection; and a rotary valve connected to the high-pressure output of the high-pressure gas storage container and connected to the low-pressure input of the low-pressure gas storage container.

8. The compressor device of claim 7, further comprising:

a cryo-cooler connected to the rotary valve, wherein the rotary valve is adapted to alternately permit high-pressure working gas from the high-pressure gas storage container to flow to the cryo-cooler, and to allow low-pressure gas from the cryo-cooler to flow to the low-pressure gas storage container.

9. A compressor device, comprising:

a first compressor chamber that is divided by a first metal bellows into a first gas volume inside the first metal bellows and a first liquid volume outside the first metal bellows, wherein a working gas is present in the first gas volume, and wherein a working liquid is present in the first liquid volume;

a first working liquid connection connected to the first liquid volume;

a first high-pressure working gas connection connected to the first gas volume;

a first low-pressure working gas connection connected to the first gas volume;

a first high-pressure check valve connected to the first high-pressure working gas connection, wherein the first high-pressure check valve permits working gas to flow only in a direction out of the first gas volume and through the first high-pressure working gas connection;

a first low-pressure check valve connected to the first low-pressure working gas connection, wherein the first low-pressure check valve permits working gas to flow only in a direction through the first low-pressure working gas connection and into the first gas volume;

a second compressor chamber that is divided by a second metal bellows into a second gas volume inside the second metal bellows and a second liquid volume outside the second metal bellows, wherein the working gas is present in the second gas volume, and wherein the working liquid is present in the second liquid volume;

a second working liquid connection connected to the second liquid volume;

a second high-pressure working gas connection connected to the second gas volume;

a second low-pressure working gas connection connected to the second gas volume;

a second high-pressure check valve connected to the second high-pressure working gas connection, wherein the second high-pressure check-valve permits the working gas to flow only in a direction out of the second gas volume;

a second low-pressure check valve connected to the second low-pressure working gas connection, wherein the second low-pressure check valve permits the working gas to flow only in a direction into the second gas volume;

a pump that compresses the working gas in the first gas volume by pumping the working liquid from the second liquid volume through the second working liquid connection, through the first working liquid connection and into the first liquid volume, and wherein the working gas in the second gas volume is compressed as the pump pumps the working liquid from the first liquid volume into the second liquid volume;

a common high-pressure output connection connected to the first and second high-pressure check valves;

a common low-pressure input connection connected to the first and second low-pressure check valves;

a high-pressure gas storage container having a high-pressure input and a high-pressure output, wherein the high-pressure input is connected to the common high-pressure output connection;

a low-pressure gas storage container having a low-pressure input and a low-pressure output, wherein the low-pressure output is connected the common low-pressure input connection; and a cryo-cooler connected to a rotary valve, wherein the rotary valve is adapted to alternately permit high-pressure working gas from the high-pressure gas storage container to flow to the cryo-cooler, and to permit low-pressure gas from the cryo-cooler to flow to the low-pressure gas storage container.

10. The compressor device of claim 9, wherein the cryo-cooler is taken from the group consisting of: a Gifford-McMahon cooler and a pulse tube refrigerator.

11. A compressor device, comprising:

a first compressor chamber that includes a first metal bellows, wherein the first metal bellows divides the first compressor chamber into a first gas volume inside the first metal bellows and a first liquid volume outside the first metal bellows, wherein a working gas is present in the first gas volume, and wherein a working liquid is present in the first liquid volume;

a low-pressure gas connection connected to the first gas volume;

a low-pressure check valve that permits the working gas to flow only in a direction into the first gas volume;

a first middle-pressure check valve that permits the working gas to flow only in a direction out of the first gas volume;

a second compressor chamber that includes a second metal bellows, wherein the second metal bellows divides the second compressor chamber into a second gas volume inside the second metal bellows and a second liquid volume outside the second metal bellows, wherein the working gas is present in the second gas volume, and wherein the working liquid is present in the second liquid volume;

a gas line connecting the first gas volume to the second gas volume via the first middle-pressure check valve;

a high-pressure check valve that permits the working gas to flow only in a direction out of the second gas volume; and a pump that pumps the working liquid between the first liquid volume and the second liquid volume, wherein the working gas in the first gas volume is compressed as the pump pumps the working liquid from the second liquid volume into the first liquid volume, and wherein the working gas in the second gas volume is compressed as the pump pumps the working liquid from the first liquid volume into the second liquid volume.

12. The compressor device of claim 11, further comprising:

a second middle-pressure check valve that permits the working gas to flow only in a direction into the second gas volume, wherein the first and second middle-pressure check valves are connected via the gas line between the first and second gas volumes.

13. The compressor device of claim 11, further comprising:

a buffer storage container arranged in the gas line between the first middle-pressure check valve and the second gas volume, wherein the working gas flows from the first gas volume, through the first middle-pressure check valve, through the buffer storage container, and into the second gas volume.

14. The compressor device of claim 11, further comprising:

a cryo-cooler, wherein the working gas flows from the second gas volume to the cryo-cooler, and wherein the working gas flows from the cryo-cooler to the first gas volume.

15. The compressor device of claim 14, wherein the cryo-cooler is a Joule-Thomson cooler.

* * * * *